US007143867B2

(12) United States Patent
Chopra

(10) Patent No.: US 7,143,867 B2
(45) Date of Patent: Dec. 5, 2006

(54) ELECTRONIC OIL LEVEL DETECTION AND REPLACEMENT SYSTEM

(75) Inventor: Kewal K. Chopra, Sterling Heights, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 618 days.

(21) Appl. No.: 10/719,848

(22) Filed: Nov. 24, 2003

(65) Prior Publication Data

US 2005/0109561 A1 May 26, 2005

(51) Int. Cl.
*F01M 11/12* (2006.01)

(52) U.S. Cl. ..... 184/103.2; 184/104.2; 184/105.1

(58) Field of Classification Search ..... 184/103.2, 184/6.1, 6.5, 103.1, 104.2, 105.1, 108, 109
See application file for complete search history.

(56) References Cited

U.S. PATENT DOCUMENTS 5,749,339 A * 5/1998 Graham et al. ..... 123/73 AD
5,881,688 A * 3/1999 Graham et al. ..... 123/73 AD
6,283,082 B1 * 9/2001 Gunshore et al. ..... 123/196 S
6,443,263 B1 * 9/2002 Ito et al. ..... 184/6.5
6,588,393 B1 * 7/2003 Chamberlin et al. .... 123/196 R
6,644,095 B1 * 11/2003 Van Mullekom et al. ..... 73/10
7,055,486 B1 * 6/2006 Hoff et al. ..... 123/196 R

* cited by examiner

*Primary Examiner*—David Fenstermacher
(74) *Attorney, Agent, or Firm*—David L. Kuhn; Luis Miguel Acosta; Thomas W. Saur

(57) ABSTRACT

An oil level monitoring and replenishment system for use with an internal combustion engine having an oil sump. The system as a sensor which continuously measures the sump level in the reservoir for holding a quantity of oil to be used in replenishment of the sump. A sensor monitors the oil level in the sump and causes replenishment from the reservoir when needed. The reservoir has warning circuit interactive with a reservoir sensor to signal from the reservoir has reached a lower level of oil and requires the filling. The sensor also provides means to signal when the reservoir has been filled to the desired level to prevent overfilling.

8 Claims, 1 Drawing Sheet

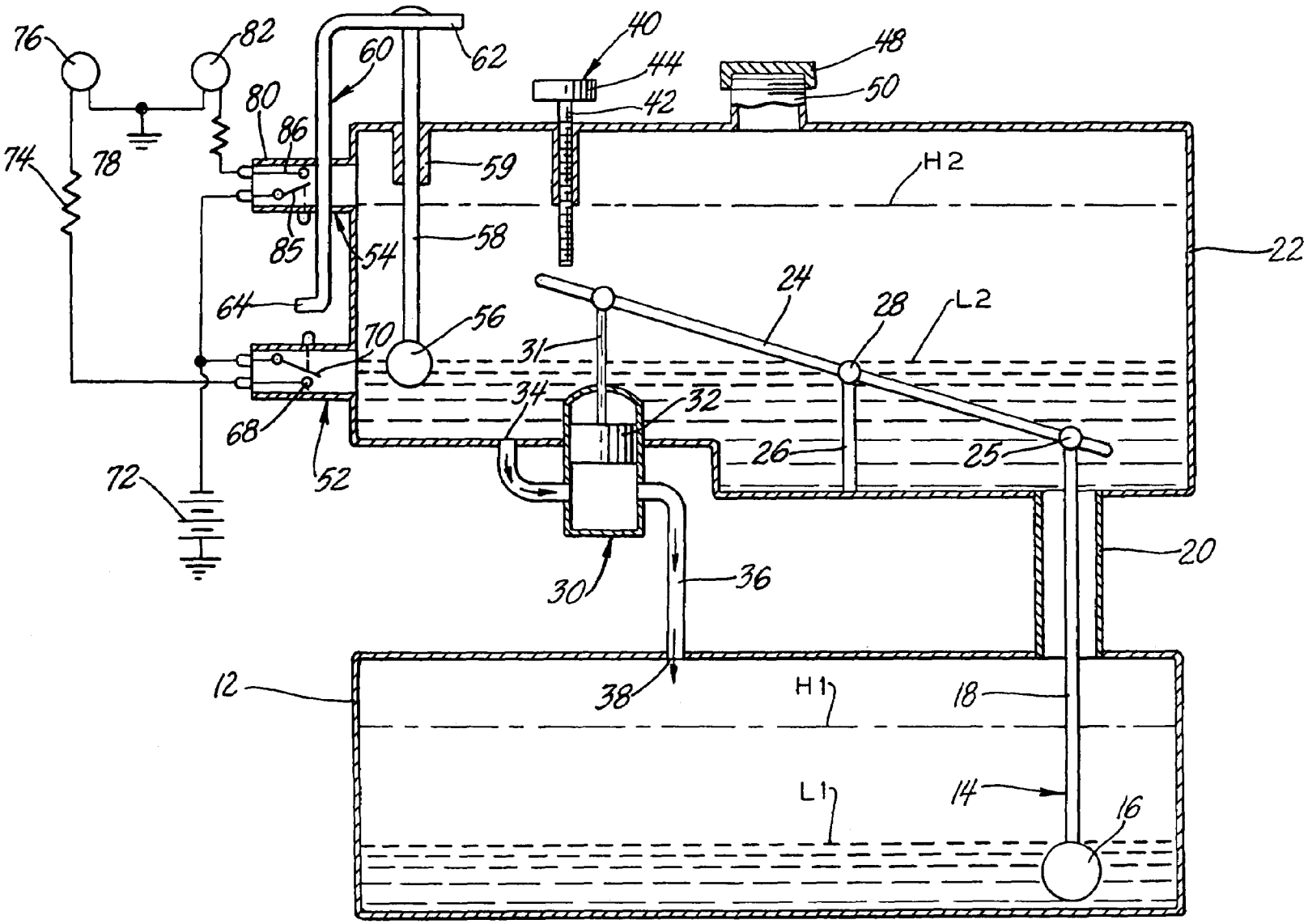
22
20
16
18
14
25
L2
H2
28
48
50
24
26
H1
L1
36
32
38
40
44
42
30
31
34
62
59
58
56
54
70
60
52
86
85
80
64
68
82
12
72
78
76
74

ELECTRONIC OIL LEVEL DETECTION AND REPLACEMENT SYSTEM

GOVERNMENT INTEREST

The invention described here may be made, used and licensed by and for the United States for governmental purposes without paying me any royalty.

BACKGROUND OF THE INVENTION

In one aspect, this invention relates to a system for replenishing engine lubricant. In a further aspect this invention relates to a replenishment system that has a lubricant level monitor and indicator.

Military vehicles operate under an unusually wide variety of conditions and may be called upon to operate for extended periods without the opportunity to perform routine maintenance. Since the problem times are likely to coincide with a time of combat, it is important that the vehicle continue to operate. One area where a vehicle can face premature failure is a loss of oil pressure caused by low oil levels in the sump. Most vehicles have a low pressure light which warns of a low sump oil level but without the means to replenish the oil, such a warning is of little value.

The present invention provides an oil fill system which can replace consumed oil from a reservoir as needed to maintain an adequate supply of lubricant in the motor sump. The system also has means to signal when the reservoir has been depleted to the extent that it requires replenishment and means to indicate when the reservoir level is properly replenished. This allows the vehicle to operate over a considerable period of time. The system is designed so the oil can be replenished rapidly if necessary even during a break in combat.

SUMMARY OF THE INVENTION

The problems of the prior art are solved by the present invention of an engine oil level monitoring and replenishing system. The system of this invention includes an engine sump which holds a quantity of oil to be used for normal engine lubrication by the engine such systems being known in the art. The sump has an associated sensor which continuously monitors the oil level in the sump and will activate a warning light near the vehicle driver when the oil level reaches a predetermined level. Such sensors normally are activated only when the oil level had reached a critical stage and the vehicle must be turned off in a very short time to avoid permanent damage. Because of the reservoir of this invention, it is believed this will seldom be necessary.

A reservoir is provided for holding a quantity of oil to be used in replenishing the oil level in the sump when it drops below a predetermined level. A valve between the reservoir and the sump will open in response to a low level of oil in the sump to renew the sump lubricant level. In addition, the system has a warning circuit interactive with the reservoir sensor to generate a signal warning the vehicle operator of the need to replenish the oil level in the reservoir. Replenishment of the reservoir when it runs low on oil will generally obviate the low oil level warning and allow the vehicle to continue on an extended tour of duty.

BRIEF DESCRIPTION OF THE DRAWINGS

In the accompanying drawing:

The FIGURE is a schematic view of one embodiment of the invention.

DETAILED DESCRIPTION

Referring to the accompanying drawing wherein like numerals refer to like parts, one embodiment of the present invention is illustrated. The invention is an engine oil level monitoring and replenishing system designed for use with an internal combustion engine, not shown, having an oil sump. The oil sump is designated generally 12 and is associated with the internal combustion engine in a manner common in the art. A further description of the sump-engine relationship is omitted in the interest of brevity.

A sump sensor 14 is associated with the sump 12 to continuously measure the oil level within the sump. The sump sensor 14 is located within the sump and has a float member 16 attached to an activating arm 18 mounted within a sleeve 20 which extends between the sump 12 and an oil reservoir 22. As the oil level in the sump 12 varies between H1 and L1, float 16 will move vertically within the sump. When the oil level in sump 12 reaches level L1, the sump 12 is considered to bellow in oil and replenishment is needed.

The reservoir 22 contains a pivot arm 24 attached to the activating arm 18 at a joint 25 the pivot arm being rotatably mounted on a pintle 26 at joint 28. The pivot arm 24 moves in response to vertical movement of the activating arm 18 to open and close a valve member 30. When the oil level in sump 12 reaches the lower-level, L1, the pivot arm 24 will raise an arm 31 moving a piston 32. This opens a connecting channel 36 between an outlet 34 in the reservoir 22 allowing oil to flow through the connecting channel 36 to inlet 38 of sump 12. When the oil level in sump 12 reaches H1, the valve 30 will close until additional lubricant is needed.

The reservoir 22 can be designed to hold sufficient oil to allow the vehicle to function over an expected mission cycle which may include several weeks without the opportunity for routine maintenance. The reservoir 22 will operate between an upper and lower level shown in the figure by dashed lines H2 and L2. The range of motion of piston 32 can be controlled by means of an adjustment member 40. In the present case, the adjustment member comprises a threaded stem 42 with a knob 44 the threaded stem being mounted in a threaded sleeve 46. Turning the threaded stem 42 will change the range of motion of activating arm 24. The adjustment will control the intervals at which oil will be used to replenish the level in the sump 12 so that the levels will vary over the desired range. When the level of oil in the reservoir fells to L2 additional oil is added to the reservoir by removing a cap 48 and adding oil through an opening 50 provided for this purpose.

The oil reservoir 22 has a low level oil switch 52 and fill level switch 54 to monitoring the reservoir oil level. The switches are activated by use of a reservoir float 56 located within the reservoir, float 56 being attached to a push arm 58 mounted in sleeve 59 so as to move vertically with respect to the reservoir 22. The push arm 58 is attached to a vertically oriented S shaped member 60 so when the push arm moves it will move arm 62 of the S shaped member 60 vertically reflecting the oil level within the reservoir 22 between the high level, H2, and the lower-level L2.

When in use, as the oil level in reservoir 22 is depleted, S shaped member 60 will move vertically downward until arm 64 contacts the low level switch 52. Activation of switch 52 will close contacts 68, 70 causing current to flow from battery 72 through a resistor 74 to a blinking LED 76. The blinking LED 76 is permanently connected to ground 78 so that when current flows it will immediately began operation to signal that the reservoir level has reached the point where it should be replenished. The blinking LED 76 is mounted in the passenger compartment as part of the vehicle driver's instrumentation. Thus, the driver will become aware that lubrication is needed while the sump is full providing a considerable operating margin of safety so that the engine sump does not go below the desired level before a warning is issued to the driver. It is expected, that even when the low level oil light associated with the reservoir is active, the vehicle could still be used. This provides a duel level of protection with a low lubricant warning issued first when the reservoir reaches the replenishment level and second when the sump reaches the replenishment level as indicated by the sump oil indicator normally associated with engines.

When the cap 48 is removed and oil is added through the opening 50, the float 56 and associated arm 58 will move the S shaped member 60 vertically until arm 64 contacts the full level switch 54. Activation of the switch will close the contacts 85, 86 causing current to flow from battery 72 through LED 82. The LED 82 will be mounted near the opening 50 so that the person adding oil will know when the level in the reservoir 22 has reached the desired level and prevent over filling of the reservoir.

Various alterations and modifications will become apparent to those skilled in the art without departing from the scope and spirit of this invention and it is understood this invention is limited only by the following claims.

What is claimed is:

1. An engine oil level monitoring and replenishment system for use with an internal combustion engine having an oil sump with a sump inlet for adding replenishment oil including:

a float located within the sump the float having an activating arm attached thereto the activating arm being attached to the first end of a pivoting arm, the float being in contact with the oil in the sump and responsive to the oil level to continuously measure the oil level;

a reservoir for holding a quantity of oil for use in replenishing the sump, the reservoir having an opening with a cap and an outlet;

a valve means associated with the reservoir, the valve means having its intake fluidly connected to the reservoir outlet and its output connected to the sump inlet, the valve means being connected to a second end of the pivoting arm so that as the pivoting arm is moved by the action of the float, the valve means opens to allow the oil from the reservoir to enter the valve means and exit into the sump;

a reservoir float located within the reservoir, the reservoir float having a push rod attached thereto the push rod being in contact with a first end of a vertically oriented S-shaped member so that movement of the reservoir float will move the S-shaped member a similar distance, the reservoir float being in contact with the oil in the sump and responsive to the oil level to continuously measure the oil level in the reservoir;

a low level oil switch attached to the reservoir the second end of the S-shaped member being located above said switch so that vertical movement of the S-shaped member will activate the switch in response, the switch having an associated warning circuit interactive with the switch and responsive to lowered oil level in the reservoir to generate a signal;

a first warning light electrically connected to the warning circuit and responsive to the signal from said circuit to indicate that the oil level has reached a critical level;

a full level switch located above the low level oil switch the full level switch attached to the reservoir above the low level oil switch with the second end of the S-shaped member being located between the low level oil switch and the full level switch above the low level switch so that vertical movement of the S-shaped member will activate the full level switch in response to the addition of oil to the reservoir, the full level switch having an associated circuit interactive with the full level switch and responsive to raised oil level in the reservoir to generate a signal; and a full level indicator light electrically connected to the interactive circuit associated with the full level switch and responsive to the signal from said circuit to indicate that the oil reservoir has reached the desired fill level.

2. The engine oil level monitoring and replenishment system of claim 1 in which the activating arm attached to the float within the sump is itself mounted within a sleeve extending between the sump and the oil reservoir.

3. The engine oil level monitoring and replenishment system of claim 1 in which the valve means further includes a connecting channel extending between valve means and sump inlet through which reservoir oil exits said valve means and enters through the sump inlet into the sump.

4. The engine oil level monitoring and replenishment system of claim 1 in which the valve means includes a valve member, a piston arm having a piston disposed at one end, said piston within said valve member, said piston arm attached to the pivoting arm, whereby movement of the pivot arm in turn moves the piston arm and the piston to open and close said valve means.

5. The engine oil level monitoring and replenishment system of claim 1 in which the reservoir further comprises an adjustment member operative on the activation arm to change its range of motion, whereby the adjustment member will control the intervals at which oil will replenish the sump.

6. The engine oil level monitoring and replenishment system of claim 5 in which the adjustment member comprises a threaded stem having a knob at a first end and a second end adapted to bear against said activating arm.

7. The engine oil level monitoring and replenishment system of claim 1 in which the warning light connected to the warning circuit of the low level oil switch is located a passenger compartment of a vehicle having said internal combustion engine.

8. The engine oil level monitoring and replenishment system of claim 1 in which the full level indicator light connected to the circuit of the full level switch is located near the opening of said reservoir.

* * * * *